United States Patent [19]

Shackleton

[11] 4,167,064

[45] Sep. 11, 1979

[54] LOADING DEVICES FOR FORM FOLLOWERS

[75] Inventor: Raymond T. Shackleton, Keighley, England

[73] Assignee: Keighley Grinders (Machine Tools) Limited, Keighley, England

[21] Appl. No.: 908,960

[22] Filed: May 24, 1978

[51] Int. Cl.[2] ..... B24B 53/08; B24B 9/00; B23D 5/04

[52] U.S. Cl. ..... 33/23 K; 33/174 P; 125/11 PH

[58] Field of Search ..... 33/23 H, 23 K, 174 P; 51/100 R, 100 P, DIG. 14; 90/62 R; 125/11 TP, 11 PH, 11 PT

[56] References Cited

U.S. PATENT DOCUMENTS

| | | | |
|---|---|---|---|
| 2,602,437 | 7/1952 | Tancred | 125/11 PH |
| 2,735,420 | 2/1956 | Dall | 125/11 PH |
| 2,911,182 | 11/1959 | Clarke et al. | 33/23 K |
| 3,731,563 | 5/1973 | Williams et al. | 33/23 K |
| 3,815,568 | 6/1974 | Gerner | 125/11 TP |

*Primary Examiner*—Richard R. Stearns

*Attorney, Agent, or Firm*—Watson, Cole, Grindle & Watson

[57] ABSTRACT

A loading device is provided for a form follower which is primarily intended for use in following with a stylus a profile provided by a template and thus determining the movement of a tool. This arrangement is particularly suitable for the control of a tool for dressing a grinding wheel. The loading device includes an actuator resiliently loaded in a carrier which slides in a body and forms with that body two chambers for which the carrier constitutes a common piston, one of the chambers communicating with an inlet for connection with a source of hydraulic pressure to urge the carrier in a first direction, the other chamber having a port controlled by a valve movable with the actuator to couple the port alternatively to an outlet for connection with a reservoir of pressure or to the inlet in accordance with movement of the actuator in the first direction or in the opposite direction, respectively, relative to the carrier, the piston having differential surface areas exposed to the two chambers such that when the port is coupled to the inlet and the pressure is the same in the two chambers the carrier is urged in the opposite direction.

15 Claims, 2 Drawing Figures

LOADING DEVICES FOR FORM FOLLOWERS

FIELD OF THE INVENTION

This invention relates to a loading device for a form follower which is primarily intended for use in following with a stylus a profile presented by a template or the like and thereby determining the movement of a tool, particularly a diamond tool which dresses a grinding wheel; and also to form followers incorporating such loading devices. In such form followers stylus and tool are rigidly attached to a slide or other mechanism which is disposed to ensure that movement of the stylus produces a corresponding movement of the tool.

SUMMARY OF THE INVENTION

According to the present invention there is provided a loading device for use in a form follower, comprising an actuator resiliently loaded in a carrier which slides in a body and forms with that body two chambers for which the carrier constitutes a common piston, one of the chambers communicating with an inlet for connection with a source of hydraulic pressure to urge the carrier in a first direction, the other chamber having a port controlled by a valve movable by or with the actuator to couple the port to an outlet for connection with a reservoir of pressure or to the inlet in accordance with movement of the actuator in the first direction or in the opposite direction, respectively, relative to the carrier, the piston having differential areas such that when the port is coupled to the inlet and the pressure is the same in the two chambers the carrier is urged in said opposite direction.

The present invention also provides a form follower incorporating such a loading device.

In a preferred embodiment of a loading device, the actuator is in the form of a rod which is resiliently loaded by means of a spring in a carrier which slides in a body and forms with that body two chambers for which the carrier constitutes a common piston. One of these chambers may be coupled to a hydraulic line to provide pressure urging the carrier forwardly. The other chamber has a port controlled by a valve which is movable with the actuator to connect that port to a reservoir of pressure or to the hydraulic line in accordance with forward or rearward movement of the actuator rod relative to the carrier. This construction of loading device enables rapid or extensive variation in the profile of a former plate to be followed quickly the differential action of the pressure chambers being balanced by the valve, yet enables the stylus of a form follower to bear on the former or template with a constant loading force determined by the spring bias. The actuator may be rigidly mounted on a support for the stylus and tool or may be coupled to the support by means of a lever arrangement or linkage.

DESCRIPTION OF PREFERRED EMBODIMENTS

Figure 1:
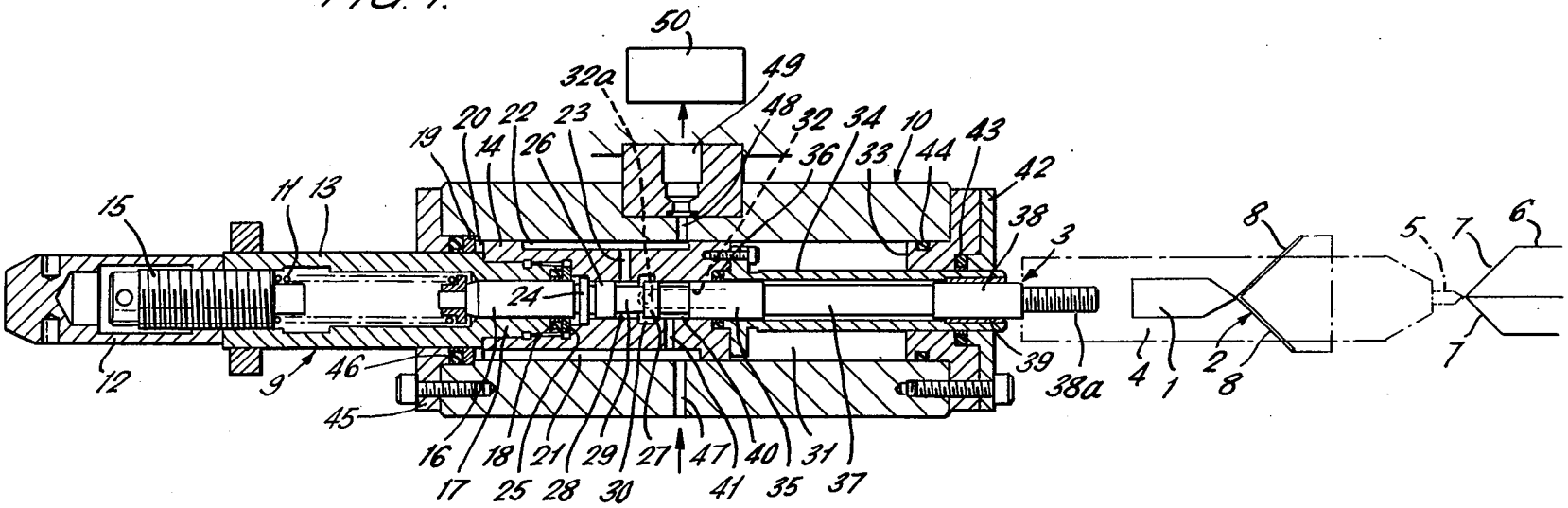
FIG. 1 is a sectional view of a form follower including a loading device of the present invention.

The form follower which is shown in FIG. 1 has a stylus 1 which bears on a former plate 2, and a diamond dressing tool 5 which, when the form follower is in operation, bears on a grinding wheel 6. The stylus 1 and diamond dressing tool 5 are rigidly mounted on a support in the form of a follower slide 4 which is rigidly connected to an actuator 3 of a loading device of the form follower. This particular form follower is intended for dressing a grinding wheel with obliquely formed grinding surfaces. The stylus and the former plate are relatively moved in two orthogonal directions. One direction of movement is transverse the axis of the stylus and is provided by moving the form follower bodily on, for example, a slideway. The other direction of movement is axially of the stylus. The stylus moves axially under substantially constant loading force supplied by the loading device.

The former plate which governs the movement of the dressing tool is an example of a former plate which has a substantial depth, for example several inches. The axial movement of the actuator is correspondingly substantial and it is difficult to ensure that substantially constant loading force is exerted on the actuator throughout this range of axial movement. If, for example, the force on the actuator were to be exerted merely by a helical spring, the variation in the force of the spring could cause positional errors which are, in effect, doubled since an error e in the position of the stylus relative to the former plate will result in an error of $2e$ in the corresponding diametrical measurement on the grinding wheel. The reduction of such positional errors is important in precision grinding where accuracies of $2.5\mu$ or better are commonly required.

The loading force which is exerted on the actuator must be sufficient to maintain the stylus in contact with the flanks 8 of the former plate at all times during dressing of corresponding flanks 7 of the grinding wheel. The force resists the tendency of the diamond dressing tool and the grinding wheel to separate. If there is a sudden change in the profile of the former plate, the actuator must respond rapidly enough to maintain contact between the stylus and the former plate. Although springs that can exert a constant tension are known, their working life is short. The particular embodiment of loading device shown in the drawings is intended to permit the actuator to respond rapidly to changes in the profile that it follows and for this purpose is in the form of a spring biassed hydraulic servo which provides a resilient loading of a carrier of the actuator. It also enables the stylus to be lifted clear of the former plate in order to allow rapid return of the form follower when dressing grinding wheels that have very steep flanks.

The form follower shown in FIG. 1 incorporates a loading device comprising an actuator 3 in the form of a elongate rod slidably mounted in a carrier 9 which is slidable in a cylindrical body 10. The carrier 9 has three principal parts, namely an outer cylindrical cap 12, an intermediate stepped cylindrical part 13, and a generally cylindrical part 14 which is a sliding fit within the body 10 and which therefore acts as a piston. A helical spring 11 is disposed between a screw plug 15, which engages a screw threading common to the end cap 12 and the intermediate cylindrical part 13, and a flanged bush carried by an inner head 16 of the actuator rod 3. The plug 15 may be screwed into or out of the outer end of the cylindrical part 13 to adjust the force exerted by the spring on the actuator rod 3, the plug being locked by the cap 12. Former plates are expensive, and therefore the compression of the spring will be adjusted to the minimum necessary to provide satisfactory functioning in order to minimize wear of the former plate.

The head 16 extends through (with clearance) an axial extension 17 of the part 13. The cylindrical part 14 which is the third principal part of the carrier and which will now be referred to as piston 14, has an axial bore which is widened at its left-hand end (as seen in FIG. 1) to accommodate the axial extension 17. This extension accommodates a sliding seal 18 for the head 16.

The body 10 has an axial bore which accommodates the piston 14. At the left-hand end of the bore is an annular liner 19 which constitutes a sleeve for the part 13. Between this liner 19 and the left-hand face of the piston 14 is an annular chamber 20 peripherally delimited by the body 10 and the part 13. This chamber 20 communicates with an inlet for hydraulic pressure by means of two diametrically opposed axially extending peripheral grooves 21 in the piston 14. The piston 14 has two other axially extending grooves 22 which are in communication through respective radial bores 23 with an axial bore 28 of the piston, one of the grooves 22 being in communication with an outlet for hydraulic medium.

In FIG. 1 the sections above and below the axis of the loading device, respectively, represent mutually inclined sectional planes, whereby only respective ones of diametrically opposed pairs of elements, such as grooves 21 are shown.

The actuator rod extends through the axial bore 28. Its movement in the bore is limited by a collar 24 next to the head 16, the collar engaging on an inwardly stepped portion of the bore 28 to define the extent of forward movement of the actuator rod relative to the carrier and engaging a sleeve 25 which is held captive in an annular recess of the wider part of the axial bore 28 to limit the rearward movement of the actuator rod relative to the carrier, and to retain the seal 18. Forwardly of the collar 24 the actuator rod is formed as two spaced apart roundels 26 and 27 which are a close sliding fit in the bore 28 and are separated by a shank 29. The roundels 26 and 27 delimit a valve chamber having a peripheral recess 30 whose axial length is substantially equal to that of the roundel 27. In the forwardly extended position of the actuator rod relative to the carrier thereof the recess 30 is in communication with the valve chamber but is cut-off from the remainder of the valve chamber as the roundel 27 moves into the narrower part of the bore 28. Accordingly the roundel 27 and the bore 28 constitute a valve for an annular chamber 31 which is defined between the right-hand face of the piston 14 and an end closure 33 at the right-hand end of the bore of body 10. This chamber 31 constitutes an hydraulic accumulator, and communicates with the recess 30 by means of two further axially extending grooves 32 and respective bores **32*a* in piston 14**.

Secured to the right-hand face of the piston 14 is the flange of a tube 34 which extends axially of the chamber 31 and constitutes a forward extension of the carrier. The actuator rod itself has a forward extension which is constituted by a shank 35 which is a sliding fit in the axial bore of the piston 14 and is encircled by a seal 36, the shank having an intermediate portion of reduced diameter 37 and an outer head 38 which is a sliding fit within a sleeve 39 at the outer end of the tube 34 and terminates in a spigot **38*a* by which it is attached to the follower slide 4. Between the shank 35 and the roundel 27 the actuator rod is of reduced diameter to define in conjunction with the bore of the piston a small annular chamber 40 which communicates with the grooves 21 by means of respective radial bores 41. The inner head 16, the shank 35 and the outer head 38** are of equal diameter.

The end closure 33 is secured to the body 10 by means of an end cap 42, bolts extending through this end cap 42 and the end closure 33 to the body 10. A seal 43, inhibiting leakage from the chamber 31, encircles the tube 34. A seal 44 is disposed in a peripheral groove of the inner part of the end closure 33 and engages the inner surface of the bore of the body 10. At the left-hand end of the body 10 there is an end cap 45 secured by bolts to the body and holding captive a seal 46 for the chamber 20. A radial bore 48 connects one of the grooves 22 to a union 49 which is connected to a hydraulic reservoir 50 for the return of spent hydraulic medium.

The loading force on the actuator rod (and hence on the stylus) is determined by the force of the spring 11. Oil or other hydraulic medium under pressure is admitted by means of an inlet duct 47 to one of the grooves 21 and thence to the chamber 20. Thereby the carrier and the actuator rod are moved bodily towards the former plate. As the stylus engages the former plate, the piston 14 continues to move forwardly with respect to the actuator rod and the valve for the chamber 31 is closed as the roundel 27 leaves the annular chamber 40 and enters the narrower part of the chamber 28. The chamber 31 is then closed with respect to the reservoir 50 but open to the duct 47 via bores 41. The supply of hydraulic medium to chamber 31 will result in a net rearward force on the piston 14 which will come to a stop and then move rearwardly with respect to the actuator rod until a position is reached where the roundel 27 is within the recess 30 and acts to balance the forces applied hydraulically to the piston by supply pressure in annular chamber 20 and by the lower pressure in annular chamber 31. Then the loading force on the stylus is determined by the spring 11. If however the stylus makes or should make a sudden forward movement to follow the former plate, forward movement of the actuator rod relative to the carrier reopens the valve for chamber 31, and in allowing exhaust from that chamber permits the pressure supplied from the inlet 47 to move the carrier and thereby the actuator rod rapidly forwardly. This action tends to close the valve again to re-establish a condition of balanced forces on the piston 14 whereby the actuator rod is maintained at a substantially constant position relative to the carrier. As mentioned, normally the valve will remain in a partially open state to balance the forces on the piston, and a disturbance of this balance will be corrected rapidly by movement of the carrier, with the contact pressure of the stylus on the former plate being maintained substantially constant by means of the spring 11. The permitted movement of the piston 14 in the body 10 is sufficient to accommodate all the axial movement of the actuator rod necessary for following the former plate 8.

The construction that has been described is useful not only in maintaining constant the loading force applied to the stylus but also providing a means for lifting the stylus from the former plate. For this purpose the union 49 is connected by means of a solenoid operated valve (not shown) to the supply of hydraulic medium so that the pressure in the chamber 31 becomes the same as that in chamber 20, and the piston 14 moves rearwardly, as a result of its differential areas, to lift the stylus from the former plate.

Figure 2:
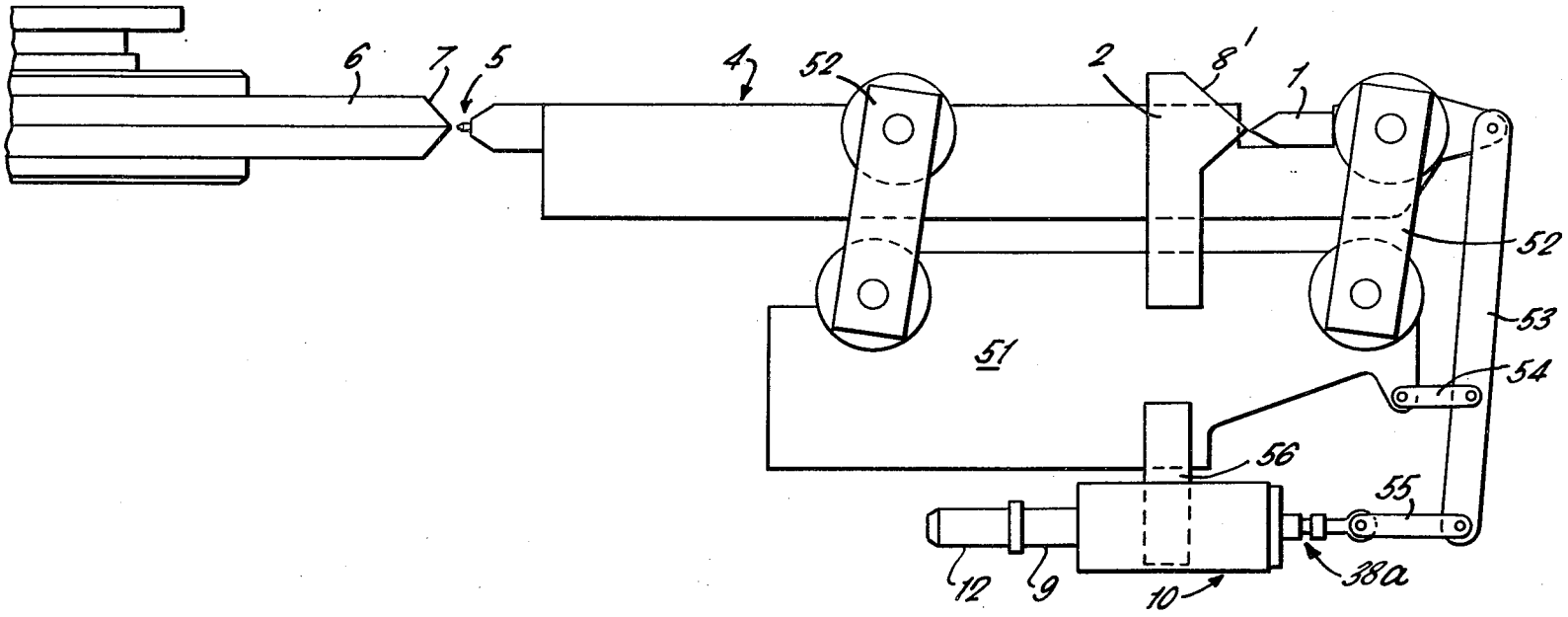
FIG. 2 is a schematic diagram of a modified form of the form follower.

FIG. 2 shows schematically an alternative arrangement in which the spigot 38*a* of the loading device is not directly attached to a follower slide 4. Instead, the loading device acts upon an intermediate linkage or lever system providing a 2:1 step-up ratio relative to the movement of the actuator rod 3. Thus to follow a former plate 8' having a depth of 4 inches, the loading device need only provide a movement of 2 inches for its actuator rod (and hence its piston). However, to provide a desired contact force against the former plate, the force exerted by the spring on the actuator rod 3 will need to be twice that for an arrangement as shown in FIG. 1, but this can be readily obtained. Furthermore, it is easier and cheaper to make the loading device having the shorter throw than the stylus movement.

In FIG. 2 the stylus 1 and dressing tool 5 are fixed to a support, in the form of an elongate bar 4 pivotally attached to a support 51 by means of two equal-length links 52 in the manner of a parallelogram. The rear end of the bar 4 is pivotally connected to the end of the longer arm of a 2:1 lever 53 whose fulcrum is pivotally connected to the support 51 by a link 54 and whose shorter arm is pivotally connected at its end to the spigot 38*a* by a link 55. The cylindrical body 10 is securely attached to the support 51 by a bar 56.

The movement of the stylus transversely of its longitudinal axis in this arrangement is achieved by moving the support 51 bodily on, for example, a slideway as described for the FIG. 1 arrangement.

In the above-described loading device, the force on the actuator rod is independent of the supply pressure, provided this exceeds a minimum value determined by the areas of the annuli and by the force required, and thus the loading device is immune to fluctuations or variation of pressure under this condition.

Under typical working conditions the length of the spring 11 is approximately 6 cms. Thus to maintain variations in the force applied to the actuator rod to less than 2%, the variation in spring length must be maintained to better than 1.2 mm, and such a performance can readily be achieved with the loading device as described above.

I claim:

1. A loading device for use in a form follower, comprising an actuator resiliently loaded in a carrier which slides in a body and forms with that body two chambers for which the carrier constitutes a common piston, one of the chambers communicating with an inlet for connection with a source of hydraulic pressure to urge the carrier in a first direction, the other chamber having a port controlled by a valve movable with the actuator to couple the port alternatively to an outlet for connection with a reservoir of pressure or to said inlet in accordance with movement of the actuator in the first direction or in the opposite direction, respectively, relative to the carrier, the piston having differential surface areas exposed to the two chambers such that when the port is coupled to the inlet and the pressure is the same in the two chambers the carrier is urged in said opposite direction.

2. A loading device as claimed in claim 1 wherein the valve couples the port to the inlet via an annular chamber defined adjacent the valve between the actuator and the carrier.

3. A loading device as claimed in claim 2 wherein the port is disposed in an internal surface of the carrier, said annular chamber being defined between said internal surface and said actuator, wherein a passage communicating with said annular chamber extends radially and axially from said internal surface to said one chamber, and wherein the valve is formed by a portion of the actuator which controls communication between the port and said annular chamber.

4. A loading device as claimed in claim 3 wherein the outlet is disposed in the body and couples to the port via another passage which extends radially from said internal surface to a chamber which itself is in communication with the outlet.

5. A loading device as claimed in claim 4 wherein the inlet is disposed in the body.

6. A loading device as claimed in claim 4 wherein the passages are spaced axially one on each side of the port, and said actuator portion is an enlarged portion which is a sliding fit in the carrier.

7. A loading device as claimed in claim 6 wherein the port is disposed in a recess in said internal surface, the axial length of the recess being substantially the same as that of said enlarged portion of the actuator.

8. A loading device as claimed in claim 5 wherein the passages are spaced axially one on each side of the port, and said actuator portion is an enlarged portion which is a sliding fit in the carrier.

9. A loading device as claimed in claim 8 wherein the port is disposed in a recess in said internal surface, the axial length of the recess being substantially the same as that of said enlarged portion of the actuator.

10. A loading device as claimed in claim 1 including means for adjusting the resilient loading of the actuator in the carrier.

11. A loading device as claimed in claim 10 wherein the actuator is resiliently loaded by a compression spring, and the adjusting means is arranged to alter the compression of the spring.

12. A form follower incorporating a loading device as claimed in claim 1.

13. A form follower as claimed in claim 12 wherein the actuator is rigidly coupled to a stylus.

14. A form follower as claimed in claim 12 wherein the actuator is coupled to a stylus by a lever arrangement or linkage.

15. A form follower as claimed in claim 14 wherein the lever arrangement or linkage is arranged such that a given displacement of the actuator produces a greater displacement of the stylus.

* * * * *